US005087170A

United States Patent [19]

Kousokabe et al.

[11] Patent Number: 5,087,170

[45] Date of Patent: Feb. 11, 1992

[54] ROTARY COMPRESSOR

[75] Inventors: Hirokatu Kousokabe, Ibaraki; Hiroshi Iwata, Odawara; Masahiro Takebayashi, Ibaraki, all of Japan

[73] Assignee: Hitachi, Ltd., Tokyo, Japan

[21] Appl. No.: 463,556

[22] Filed: Jan. 11, 1990

[30] Foreign Application Priority Data

Jan. 23, 1989 [JP] Japan ..... 1-12000

[51] Int. Cl.[5] ..... F01D 25/00; F01M 1/00

[52] U.S. Cl. ..... 415/110; 417/366; 417/902; 184/6.016; 184/6.018; 184/6.024

[58] Field of Search ..... 415/110, 111, 112, 169.1, 415/170.1, 229; 417/313, 366, 902, 363, 372, 373; 210/360.1, 360.2; 184/6.16, 6.18, 6.24

[56] References Cited

U.S. PATENT DOCUMENTS

| | | | |
|---|---|---|---|
| 1,230,206 | 6/1917 | Niemeyer et al. | 415/112 |
| 2,130,276 | 9/1938 | Hornaday | 417/902 |
| 3,104,051 | 9/1963 | Henning et al. | 417/902 |
| 3,248,044 | 4/1966 | Parker | 417/372 |
| 3,736,076 | 5/1973 | Ayling | 417/372 |
| 4,137,014 | 1/1979 | Parker | 417/902 |
| 4,472,114 | 9/1984 | Fujiwara et al. | 417/902 |
| 4,477,233 | 10/1984 | Schaefer | 417/366 |
| 4,564,339 | 1/1986 | Nakamura et al. | 417/366 |
| 4,568,253 | 2/1986 | Wood | 417/902 |
| 4,592,703 | 6/1986 | Inaba et al. | 417/366 |
| 4,717,316 | 1/1988 | Muramatsu et al. | 417/902 |
| 4,762,471 | 8/1988 | Asanuma et al. | 417/902 |
| 4,764,086 | 8/1988 | Jesinger | 415/112 |
| 4,834,623 | 5/1989 | Triolo et al. | 417/366 |

FOREIGN PATENT DOCUMENTS

| | | | |
|---|---|---|---|
| 139886 | 10/1981 | Japan . | |
| 0031683 | 2/1986 | Japan | 417/902 |
| 229988 | 10/1986 | Japan . | |
| 0954656 | 9/1982 | U.S.S.R. | 415/112 |

*Primary Examiner*—Edward K. Look
*Assistant Examiner*—Hoang Nguyen
*Attorney, Agent, or Firm*—Antonelli, Terry Stout & Kraus

[57] ABSTRACT

A rotary compressor of the invention comprises an oil separating portion and an oil collecting portion located adjacent one end of a rotary shaft closely to a motor. An oil is separated through the oil separating portion and collected in the oil collecting portion in which the one end of the rotary shaft is submerged to lubricate a third bearing. The oil separating portion serves to separate oil mist which flows with gas flow. The one end of the rotary shaft is submerged in the oil as collected in the oil collecting portion under the influence of gravity to lubricate the bearing. This arrangement provides stable lubrication of the one end of the rotary shaft. The bearing is, thus, highly reliable while the rotary compressor is running at any speeds. Also, vibrations of the shaft can substantially be reduced particularly when the rotary compressor runs at a high speed.

39 Claims, 12 Drawing Sheets

ROTARY COMPRESSOR

BACKGROUND OF THE INVENTION

1. Field of the Invention

The present invention relates to a rolling piston type rotary compressor including an inverter controller for use in an air conditioner or a refrigerator and, more particularly, to a rotary compressor designed to ensure reliable operation as well as to reduce vibrations of a rotary shaft.

2. Description of the Relevant Art

A conventional rotary compressor of the rolling piston type typically includes upper and lower bearing assemblies by which a rotor of motor is journalled in a cantilever fashion. Japanese laid-open patent publication No. Showa 61-229988 discloses a rotary compressor wherein an upper bearing is adapted to rotatably support one end of a rotary shaft in a motor and is fixedly connected to a stator of the motor. Japanese laid-open patent publication No. Showa 61-31683 also discloses a rotary compressor wherein a rolling bearing is provided at the upper end of a rotor. The inner diameter of the rolling bearing is greater than the diameter of a rotary shaft, and the inner ring of the rolling bearing is not integrally fixed to the rotary shaft. Another rotary compressor, as disclosed in Japanese laid-open utility model publication No. Showa 56-139886, includes a bearing assembly situated above a motor to jouranal the upper end of the rotary shaft.

Although the upper end of each rotary shaft bearing in the prior art rotary compressors, no attempt has been made to provide the manner of lubricating such bearings when the motor is rotated at low and high speeds and reduce the amount of oil which may be discharged to a circulating system. Consequently, lubrication is not sufficiently effected when the motor is rotated at a low speed where fast pumping can not be expected as well as at a high speed. It is also to be noted that oil around the bearing by which the upper end of the rotary shaft is journalled tends to flow into the circulating system from a closed casing as gas is discharged therefrom. The discharge of the oil deteriorates the operation of a heat exchanger and thus a cooling cycle. In addition, such discharge of the oil results in a lower oil level, causing not only insufficient lubrication of vanes, but insufficient supply of the oil to the bearings as well. This results in unreliable operation of the prior art rotary compressors.

The manner in which the rotary shafts are journalled by the bearings used in the prior art rotary compressor in no way prevents inproper contact therebetween in the event of bending or any other form of deformation of the rotary shaft. Greater pressure is thus locally applied to the surfaces of the rotary shafts and the bearings. This results in an increase in the loss of sliding movement, and thus unreliable operation of the prior art rotary compressors.

However, no attempt was made in the prior art rotary compressor to prevent any loss of such sliding movement between the shafts and the bearings.

SUMMARY OF THE INVENTION

It is a first object of the present invention to provide a rotary compressor wherein a mechanism is provided to ensure constant supply of oil to the end of a rotary shaft of a motor, and wherein the end of the rotary shaft is journalled by a highly reliable bearing.

It is a second object of the present invention to provide a rotary compressor which is capable of reducing the amount of oil which may be discharged out of the rotary compressor in an effort to improve cycle efficiency as well as the reliability of the rotary compressor.

It is a third object of the present invention to provide a rotary compressor which is capable of reducing vibrations particularly when a motor is. rotated at a high speed.

It is a fourth object of the present invention to provide a rotary compressor wherein no improper contact takes place in a bearing assembly even if a rotary shaft is bent or deflected during operation of the compressor.

It is a fifth object of the present invention to provide an improved rotary compressor which ensures smaller vibration of a rotary shaft as well as lesser loss of sliding movement between the rotary shaft and a bearing.

In order to accomplish the first object, a rotary compressor according to the present invention includes an oil separating and collecting portions adjacent to one end of a rotary shaft (remote from a compression mechanism connected to a motor). The end of the rotary shaft is submerged in oil by which a third bearing is lubricated. A spiral oil channel, as necessary, is formed where the rotary shaft is in sliding contact with the third bearing so as to improve lubrication of the bearing.

In order to accomplish the second object of the invention, a gas discharged out of the compression mechanism is passed through the oil separating portion. Thereafter, the gas enters into a cycle through a discharge pipe.

In order to accomplish the third object of the invention, the diameter of the rotary shaft journalled by the third bearing is determined so that a primary natural frequency of the shaft is greater than 1000 Hz or five times greater than a predetermined maximum frequency of the rotary compressor.

In order to accomplish the fourth object of the invention, the surface of the shaft is spherical and is engaged with the spherical concaved surface of the third bearing.

In order to accomplish the fifth object of the invention, a primary natural frequency of the shaft is five times greater than a predetermined maximum frequency of the rotary compressor, and the diameter of the bearing is smaller at a sliding contact position thereof with the shaft.

BRIEF DESCRIPTION OF THE DRAWINGS

A better understanding of the present invention may be had by reference to the following description of the preferred embodiments when taken in conjunction with the accompanying drawings, in which.

DESCRIPTION OF THE PREFERRED EMBODIMENTS

Figure 1:
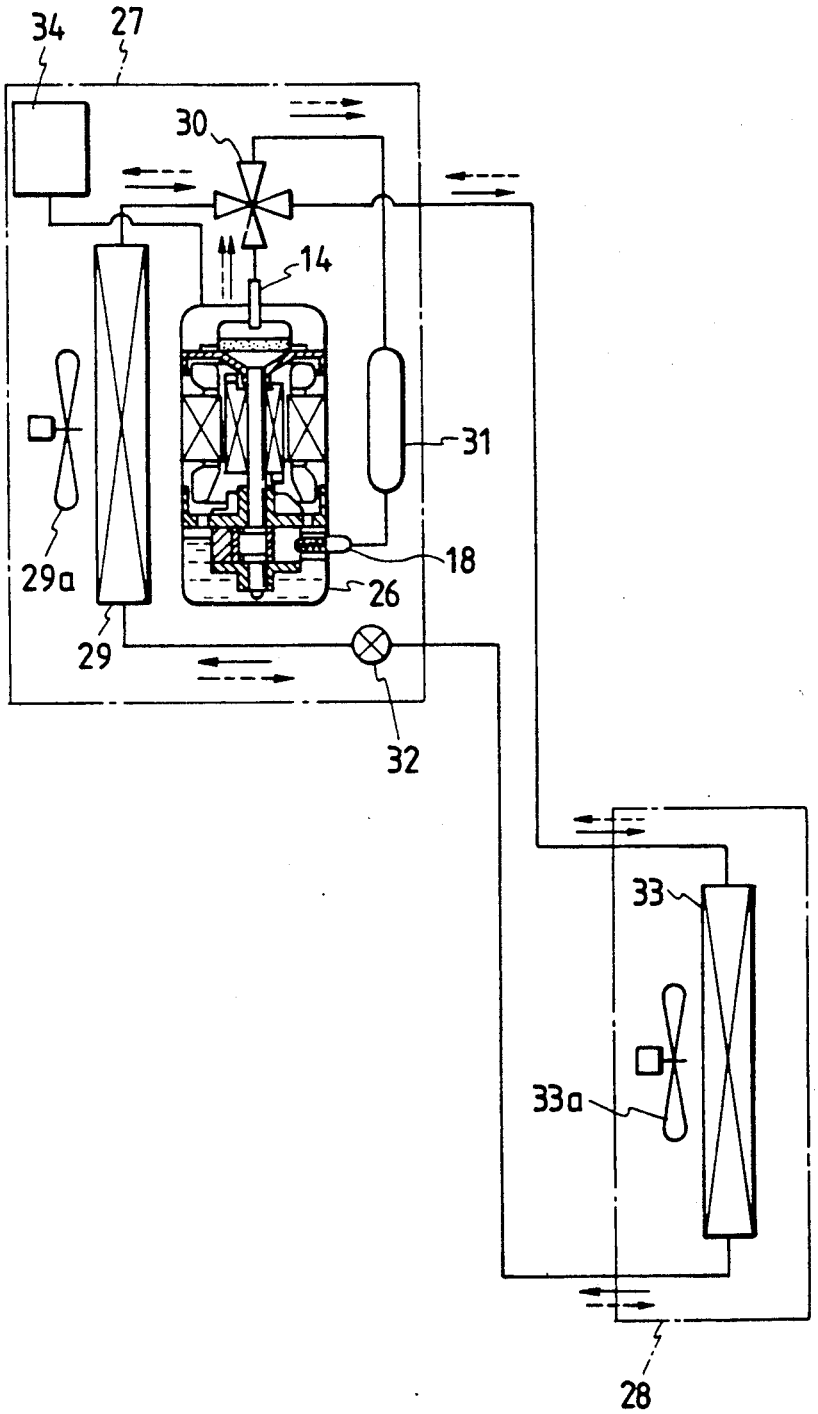
FIG. 1 is a schematic view of a cooling/heating cycle into which a rotary compressor according to this invention is incorporated.

Referring now to the drawings wherein like reference numerals are used throughout the various views to designate like parts and, more particularly, to FIG. 1, according to this figure a cycle or circulating system to which a rotary compressor according to the present invention is applied includes an external unit 27 and an internal unit 28. The external unit 27 includes therein a rotary compressor 26 of the invention, a heat exchanger 29, a fan 29*a*, a 4-way valve 30, an expansion valve 32, and an inverter controller 34. The internal unit 28 includes therein a heat exchanger 33 and a fan 33*s*. When operated as a heater, a cooling medium at high temperature and under high pressure, after being discharged from the rotary compressor 26, flows in the direction of the solid arrow and enters through the 4-way valve 30 into the heat exchanger 33 and is liquified. The cooling medium in a liquid form is the passed through the expansion valve 32 and subjected to adiabatic expansion so as to reduce the temperature and pressure of the cooling medium. Thereafter, the cooling medium is delivered to the heat exchanger 29 and is gasified as a result of heat exchange. The cooling medium in gaseous form is passed through an accumulator 31 and returned to the rotary compressor 26 through an inlet pipe 18. When operated as a cooler, the 4-way valve 30 is rendered operative to change the direction in which the cooling medium flows. Namely, the cooling medium at high temperature and under high pressure, after being discharged from the rotary compressor 26, first flows in the direction of the broken arrow, a direction opposite to the direction in which the cooling medium flows when the system is operated as a heater. The cooling medium enters into the heat exchanger 29 and is liquified, with the liquid from the cooling medium then being passed through the expansion valve 32 and subjected to adiabatic expansion. Thereafter, the cooling medium enters into the heat exchanger 33, is evaporated, and is then returned to the rotary compressor 26.

Both the internal unit 28 and the external unit 27 include means such as, for example, temperature sensors (not shown), for detecting a change in heating loads or cooling loads. If such a change is detected by the temperature sensors, a microcomputer (not shown) is operated to calculate the speed of rotation of the rotary compressor 26, the amount of air in the fans, and the mount of opening in the expansion valve 32 and to send instructions to the inverter controller 34. The rotary compressor 26 is rotated at such a speed as determined in accordance with these instructions.

Figure 2:
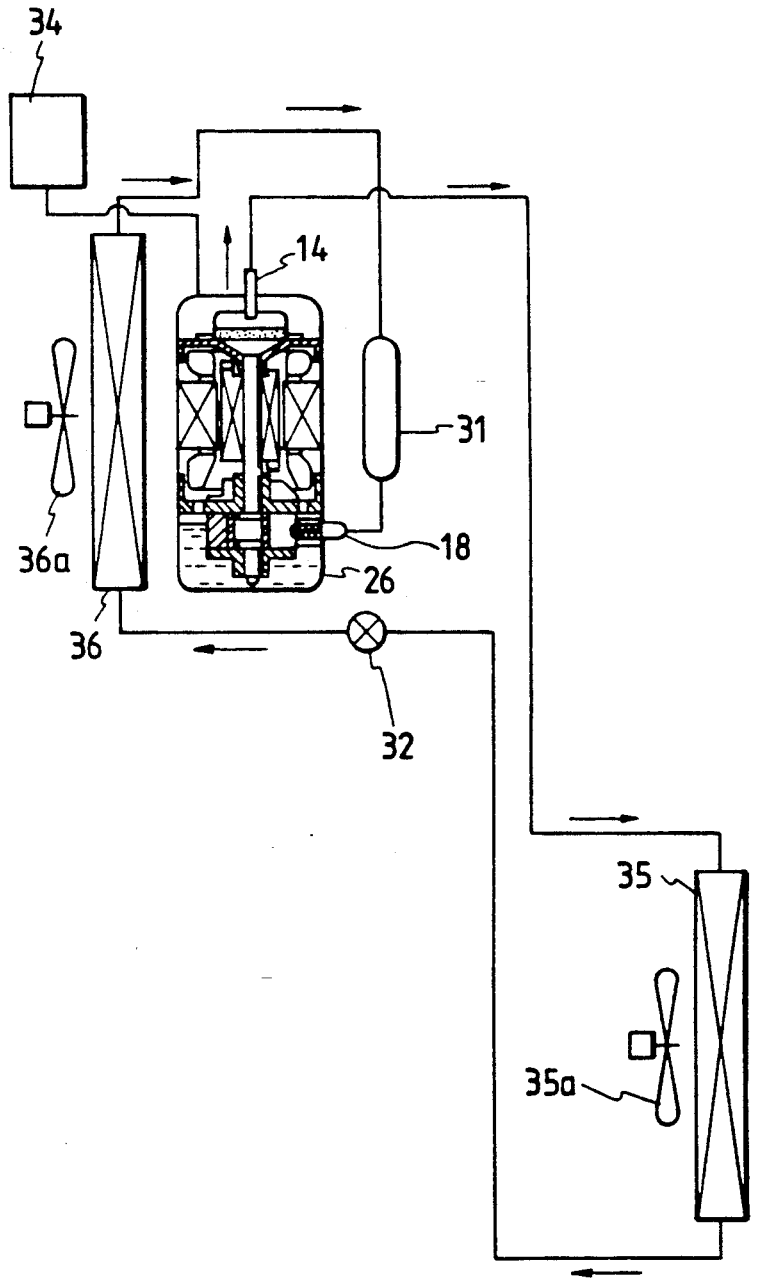
FIG. 2 is a schematic view of a cooling cycle in a cooling apparatus or a refrigerator into which a rotary compressor according this invention is incorporated.

The rotary compressor constructed according the invention may be incorporated into a cycle of circulating system as shown in FIG. 2. This system generally includes the rotary compressor 26 of the present invention, a condenser 35, a fan 35*a*, an expansion valve 32, the inverter controller 34, an evaporator 36, and another fan 36*a*. When operated, a cooling medium at high temperature and under high pressure, after discharged from the rotary compressor 26, flows in the direction of the solid arrow and enters into the condenser 35 whereby it is liquified as a result of heat exchange. The cooling medium, in liquid form, is then throttled by the expansion valve 32 or is subjected to adiabatic expansion thereby decreasing the temperature and pressure of the cooling medium. Thereafter, the cooling medium enters into the evaporator 36 and is gasified. The cooling medium, in gaseous form, is passed through the accumulator 31 and returned to the rotary compressor 26 through the inlet pipe 18.

Figure 3:
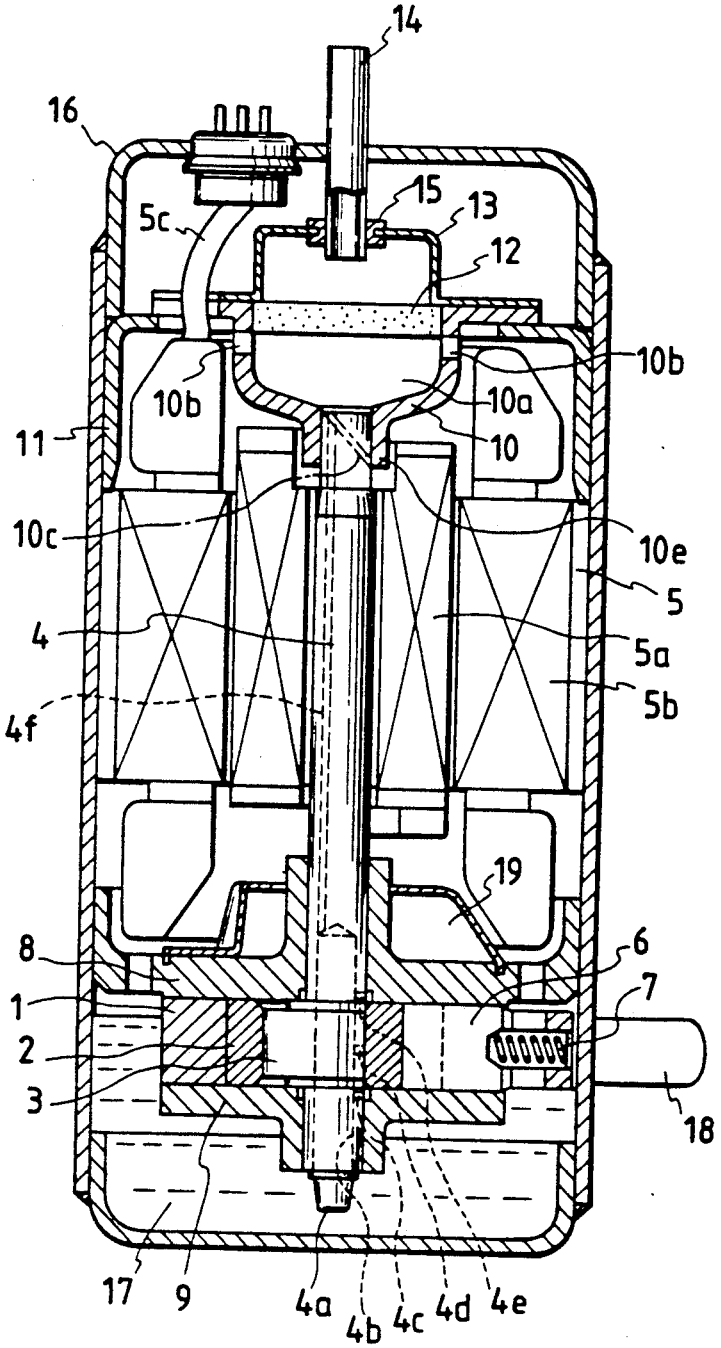
FIG. 3 is a vertical sectional view of a rotary compressor according to one embodiment of the present invention.
Figure 4:
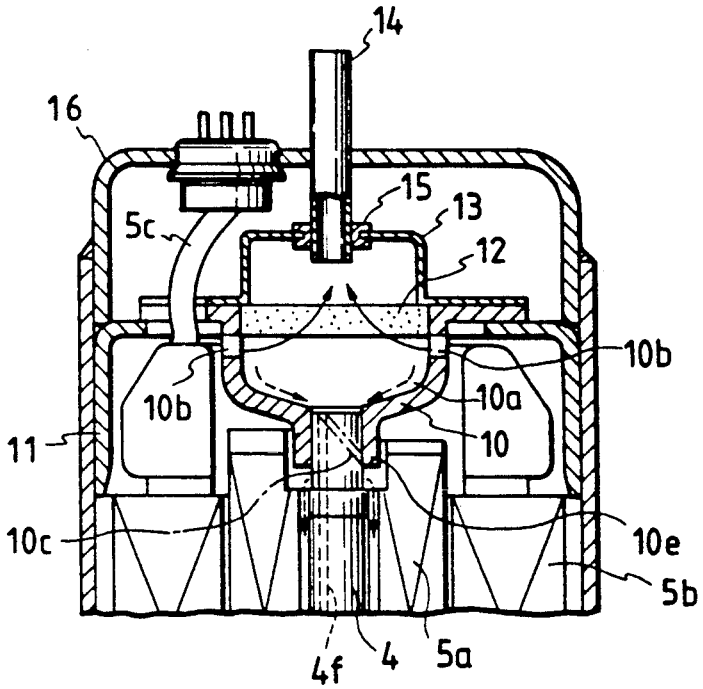
FIG. 4 is a partial sectional view showing the principal part of the rotary compressor of FIG. 3.

As shown in FIGS. 3 and 4, a vertical rotary compressor according to the invention comprises compression mechanism including a cylinder 1 within which a roller 2 is rotated in an eccentric fashion by a crank 2. A rotary shaft 4 is integrally formed with the crank 2 and journalled by a a first bearing 8 serving as an end plate for a compression chamber, and a second bearing 9. A vane 6 is arranged within the cylinder 1 to divide the interior of the cylinder 1 into an inlet chamber and the compression chamber and is reciprocatingly movable within the cylinder 1 while being in contact with the roller 2. A spring 7 urges the vane 6 against the roller 2. An inlet hole (not shown) is formed in the cylinder 1 to provide a communication between the inlet pipe 18 and the inlet chamber. A discharge valve (not shown) is located either in the first bearing 8 or the second bearing 9. The compression mechanism also has a discharge chamber 19 within the cylinder 1. The compression mechanism is situated in the lower section of a casing 16 and is half submerged in a lubrication oil 17 which is contained in the bottom of the casing 16. A motor 5 occupies the upper section of the casing 16 and includes a stator 5*a*, fixed to the casing 16 by shrink fitting or any other fastening process, and a rotor 5*b* fixedly secured to the rotary shaft 4. The rotational speed of the motor 5, such as a DC brushless motor, is varied by the inverter controller 34 in accordance with cooling or heating loads. Located above the motor 5 is a third bearing section 10 mounted to the casing 16 through a frame 11 which is, in turn, welded or press fitted to the inner surface of the casing. The third bearing section 10 has an outer peripheral portion for mounting to the frame 11 and is tapered downwardly from the outer peripheral portion to form a cup shaped oil collecting portion 10*a*. A third bearing 10*e* is formed at the center of the third bearing section as best seen in FIG. 4. Formed in the outer peripheral portion of the third bearing section 10 is a hole (not shown) through which a suitable lead line extends to connect the motor 5 to the inverter controller 24. A gas passage 10*b* is defined in the outer peripheral surface of the oil collecting portion 10*a* to direct the gas to a discharged pipe 14 which, in turn, extends through the upper end of the casing 16. There is a gap between the third bearing 10*e* and the rotary shaft 4. Alignment of the rotary shaft 4 with respect to the third bearing 10*e* is achieved by positioning the third bearing section 10 relative to the frame 11 while taking torque into consideration. Situated above the third bearing section 10 is a cover 13 surrounding the discharge pipe 14 through a seal 15. Sandwiched between the third bearing section 10 and the cover 13 is an oil filter 12 placed over the gas passage 10*b* to separate and collect oil mist which may be conveyed with a flow of gas.

In operation, the inverter controller 34 receives instructions from the microcomputer to thereby determine the speed of rotation of the motor 5. Rotation of the motor 5 causes the rotary shaft 4 and thus the roller 2 to rotate whereby the capacity of the compression chamber is gradually reduced, thereby resulting in an increase in the pressure of the cooling gas introduced through the inlet pipe 18. This high pressure gas enters into the interior of the casing 16 through the discharge valve and the discharge chamber 19. Thereafter, the cooling gas, together with oil mist, flows upwardly through a gap between the rotor 5*a* and the stator 5*b* of the motor 5 and a passageway in the outer periphery of the stator 5*b*, enters into the oil collecting portion 10*a* through the gas passage 10*b* in the third bearing section 10, and flows into the circulating system through the discharge pipe 14 while the oil mist is removed from the cooling gas as it impinges the impingement plate 12. The oil, as separated from the cooling gas, is collected in the bottom of the oil collecting portion 10*a* under the influence of gravity to thereby lubricate the upper end of the rotary shaft 4.

Upon rotation of the rotary shaft 4, an oil pump 4*a*, mounted to the lower end of the rotary shaft 4, is rendered operative to pump the oil by centrifugal pumping operation with the lower end of the rotary shaft 4 being submerged in the lubricating oil contained in the bottom of the casing 16. This oil flows through oil ports 4*c*, 4*d*, and 4*e* and is supplied to the sliding surfaces of the second bearing 9, the roller 2 and the first bearing 8. In the illustrated embodiment, a spiral channel 10*c* is formed at the upper end of the rotary shaft 4. Lubrication of the third bearing section 10 is effected as follows. When the rotary compressor runs at a relatively low rotational speed, for example, 5000 rpm or less, the lubricating oil 17 may not be sufficiently supplied through an oil port 4*f* due to slow pumping of the oil pump 4*a*. At this time, loads to be applied to the third bearing section 10 are relatively small since an unbalanced centrifugal force by the rotor 5*a* applied to the rotary shaft 4 is also small. In this case, the lubricating oil contained in the bottom of the oil collecting portion 10*a* is supplied to the sliding surface of the third bearing 10*e* through the spiral channel 10*c* to thereby prevent seizing thereof. The inner diameter of the third bearing 10 is equal to or slightly greater than a diameter of each of the first bearing 8 and the second bearing 9 and is sufficiently smaller than the gap between the rotor 5*a* and the stator 5*b*, thereby preventing deflection of the rotary shaft 4.

When the rotary compressor 26 runs at a rotational speed of 5000 rpm or faster, centrifugal pumping by the oil pump 4*a* is improved. Accordingly, a sufficient flow of oil is raised through the oil port 4*f* so as to ensure a sufficient amount of lubricating oil to be supplied to the third bearing 10*e*. In the illustrated embodiment, the upper end of the oil port 4*f* is in fluid communication with the spiral channel 10*c* through which the lubricating oil flows downwardly to lubricate the sliding surface of the third bearing 10*e*. Then, the lubricating oil further flows downwardly through a passageway in the rotor 5*a* and is collected in the bottom of the closed casing 16. As stated earlier, the oil mist, which flows with the gas flow, is separated through the oil filter 12 and is collected in the bottom of the oil collecting portion 10*a*. Thereafter, this oil mist flows through the spiral channel 10*c* and is collected in the bottom of the casing 16. With this arrangement, a sufficient supply of oil is maintained, while the rotary compressor 26 is running at a high speed, in an effort to cool the sliding surfaces of the bearings, thus preventing seizing of any compressor part and substantially improving the reliability of the rotary compressor.

As the upper portion of the rotary shaft 4 is supported by such highly reliable bearing assembly, a primary natural frequency of the shafts remarkably becomes high. It is for this reason that, if the rotary compressor runs faster, vibrations of the shaft remains small, thereby allowing the rotary compressor to run in a quiet manner. Additionally, the amount of oil mist which may flow out of the rotary compressor is substantially reduced, and the amount of lubricating oil is maintained at a constant level so as to prevent seizing of the vane 6. Thus the rotary compressor is highly reliable when running at a high speed. In the illustrated embodiment, the rotary compressor is of the rolling piston type, but is may be of the multiple-vane type.

Figure 5:
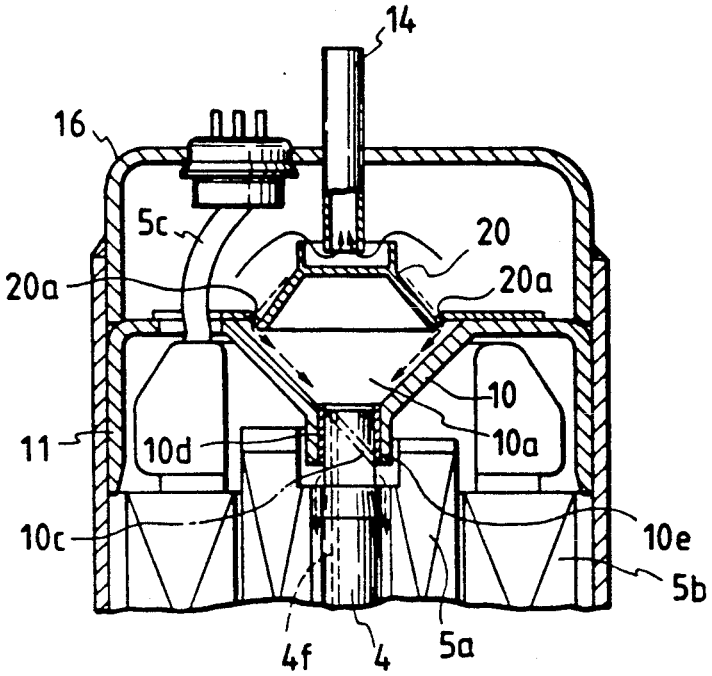
FIGS. 5 through 9 are partial sectional views showing the principal parts of modified forms of the rotary compressor.

As shown in FIG. 5, a baffle plate located between the oil collecting portion 10*a* of the third bearing section 10 and the discharge pipe 14 and is fixedly secured to the frame 11 in covering relationship with respect to the oil collecting portion 10*a*. The baffle plate 20 is frustoconical in shape and is centrally raised to surround the lower end of the discharge pipe 14 so that the oil mist, flowing with the gas flow, may impinge thereon and is separated from the gas flow. An oil hole 20 is provided through which separated oil is directed to the oil collecting portion 10*a*. In the illustrated embodiment of FIG. 5 the frame 11 and the third bearing section 10 are formed in an integral fashion. It is to be noted that the centering of the bearing must be accurate. Any other parts of the rotary compressor are similar in structure and operation to the rotary compressor shown in FIGS. 3 and 4. Oil mist, as conveyed with a flow of gas (shown by the solid arrow), impinges against the raised portion of the baffle plate 20 and is thereby separated from the cooling gas. Thereafter, this oil flows along the surface of the frustoconical baffle plate 20 in a downward direction under the influence of gravity, is delivered to the bottom of the oil collecting portion 10*a* through the oil hole 20*a*, and flows downwardly through the spiral channel 10*c* in the rotary shaft 4 to effect lubrication of the bearings. In the embodiment of FIG. 5, neither gas flows through the oil collecting portion 10*a*, nor is there any interference between the oil and gas flows, thereby ensuring a constant lubrication of the bearings.

Figure 6:
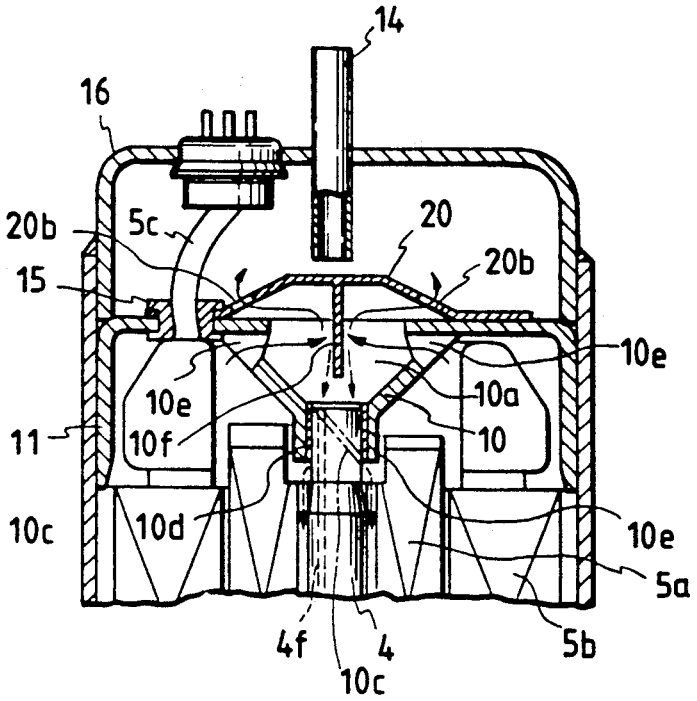

In the embodiment of FIG. 6, the third bearing section 10 is partially cut to provide a gas inlet 10*e* therein. The baffle plate 20 is fixedly secured to the frame 11 in covering relationship with respect to the oil collecting portion 10*a* and is located between the discharge pipe 14 and the oil collecting portion 10*a*. Centrally disposed on the underside of the baffle plate 20 in an impingement plate 10*f* against which gas introduced through the gas inlet 10*e* may impinge. A gas passage 20*b* is formed at the outer peripheral portion of the baffle plate 20. A bearing metal 10*d* is inserted into the third bearing 10*e*. The rotary shaft 4 has the spiral channel 10*c*. In order to allow gas to pass through the gas inlet 10*e*, the lead line 5*c* carries a seal 15. As in the embodiment shown in FIG. 5, a separation of oil from the gas takes place when the gas flows in a different direction after impinging the impingement plate 10*f* as shown in the solid arrow.

Figure 7:
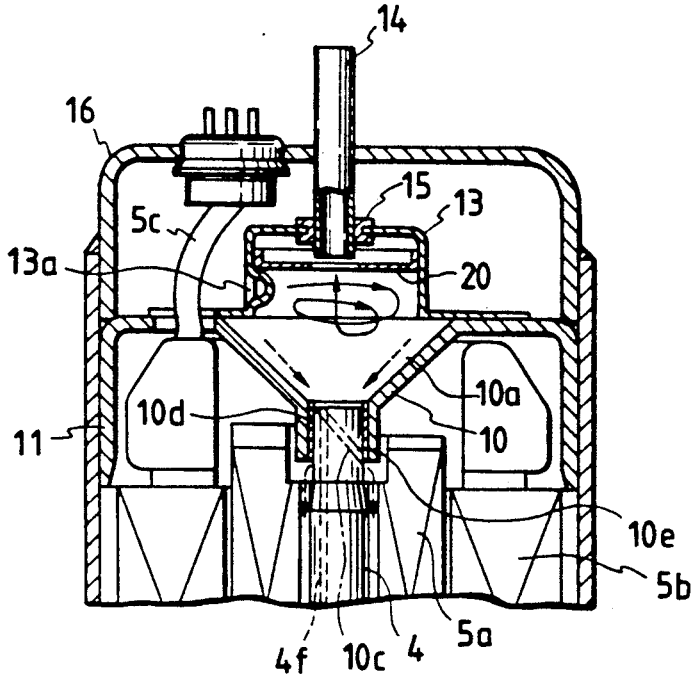

In the rotary compressor of FIG. 7, the cover 13 is fixedly secured to the frame 11 and has a central cylindrical portion surrounding the discharge pipe 14. The seal 15 is disposed between the outer peripheral surface of the discharge pipe 14 and the cover 13. Within the cover 13, the baffle plate 20 is placed in adjacent and confronting relationship to the discharge pipe 14 and has an opening. A gas inlet 13*a* is formed in the cover 13 through which gas enters into the cover in a tangential direction, whereby the gas flows in a cyclical manner within the cover 13 as shown by the solid arrow. Centrifugal force resulting from this cyclical motion of the gas causes separation of the oil from the gas. The oil is then directed to the oil collecting portion 10*a* under the influence of gravity as shown by the broken arrow, and is supplied through the spiral oil channel 10*c* to the sliding surface of the third bearing section 10. As a result, the oil is prevented from flowing out of the casing 16, thereby providing a constant lubrication of the third bearing 10*e*.

Figure 8:
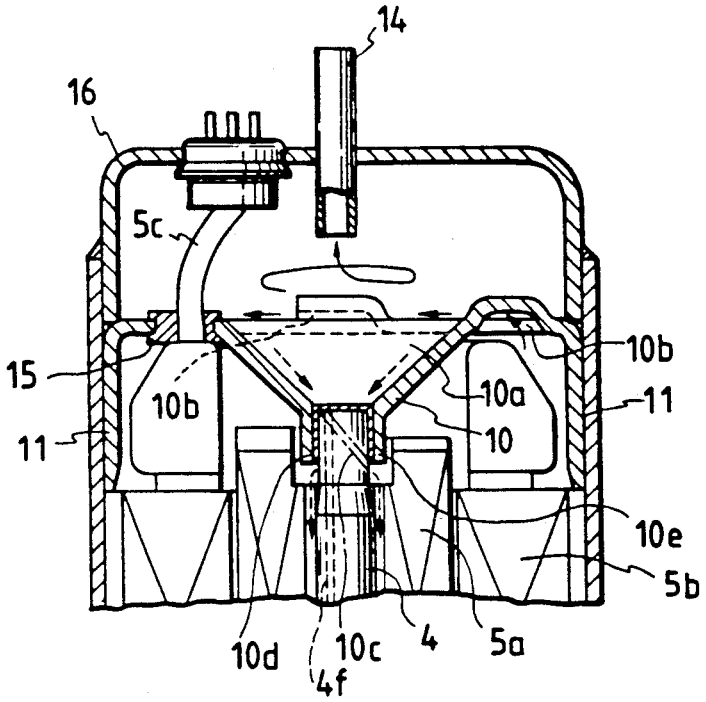

In the rotary compressor of FIG. 8 to facilitate separation of oil from the gas, the outer peripheral portion of the third bearing section 10 is raised in a tangential direction of the closed casing so as to form a gas passage 10*b*. The third bearing section 10 has the seal 15 for the lead line 5*c* by which gas is directed to the gas passage 10*b*. With this arrangement, the gas flows in a cyclical fashion within the cylindrical casing 16 as shown by the solid arrow. As in the embodiment of FIG. 7, centrifugal force resulting from the cyclical motion of the gas causes separation of the oil from the gas.

Figure 9:
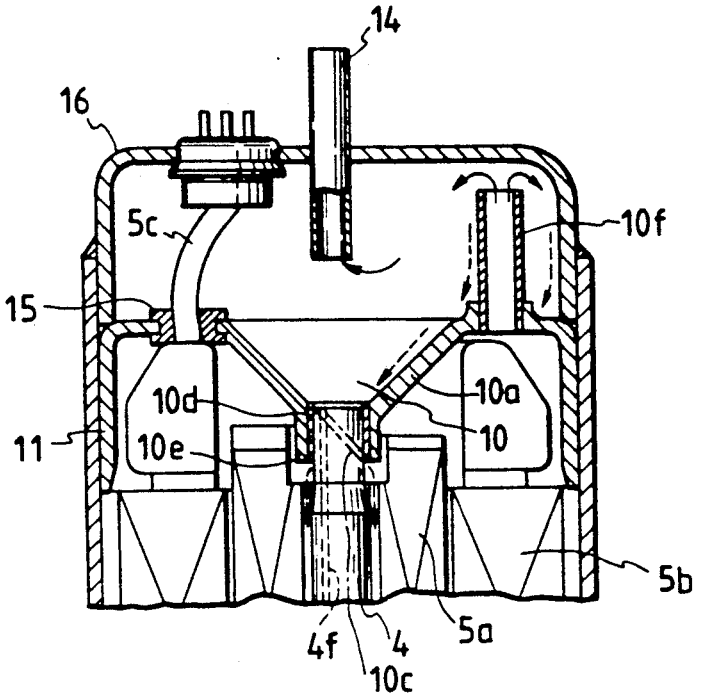

In the rotary compressor of FIG. 9, an injection pipe 10*f* extends vertically at the outer peripheral portion of the third bearing section 10 in spaced relation to the discharge pipe 14, with gas flowing through the injection pipe 10*f* to impinge upon an inner wall at an upper end of the casing 16. The seal 15 is mounted in an area in which the lead line 5*c* extends through the third bearing section 10. When gas, after flowing through the injection pipe 10*f*, impinges the inner wall of the casing 16, the direction of gas flow is changed, thereby causing separation of the oil from the gas. The oil is then directed to the oil collecting portion 10*a* of the third bearing section 10 as shown by the broken arrow, and is supplied through the spiral oil channel 10*c* to the sliding surface of the third bearing 10*e*. This embodiment is simple in construction, but provides the same advantageous effects as in the embodiment shown in FIGS. 3 and 4.

Figure 10:
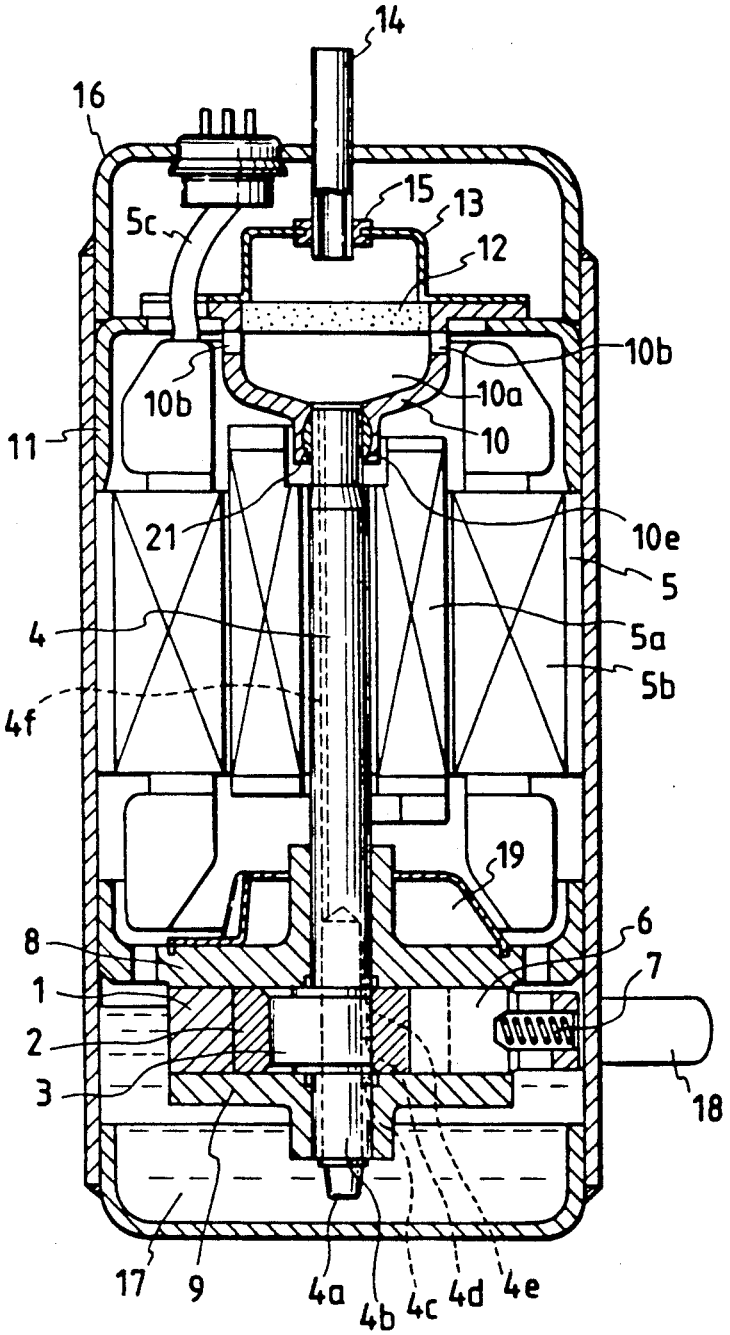
FIG. 10 is a vertical sectional view of an alternative rotary compressor.

The rotary compressor of FIG. 10 is similar in construction to the the compressor of FIG. 3, but differs therefrom in that the sliding surface of the third bearing 10*e* is spherical in shape, and a spherical bush 21 is press fitted to the upper end of the rotary shaft 4 to engage the third bearing 10*e* with a slight gap therebetween. This arrangement ensures proper sliding contact between the rotary shaft 4 and the third bearing 10*e* even if the rotary shaft 4 is deflected due to centrifugal force resulting from the an unbalanced disposition of the rotor 5*a* when the rotary compressor runs at a high speed and thus, inclines relative to the third bearing 10*e*, or the third bearing 10*e* is accidentally mounted in an inclined manner. As no seizing of the third bearing 10*e* due to improper contact occurs, the reliability of the third bearing 10*e* is improved. Also, the axis of the third bearing 10*e* can be inclined to some extent relative to that of the rotary shaft 4 so as to facilitate assembly of the rotary compressor.

Figure 11:
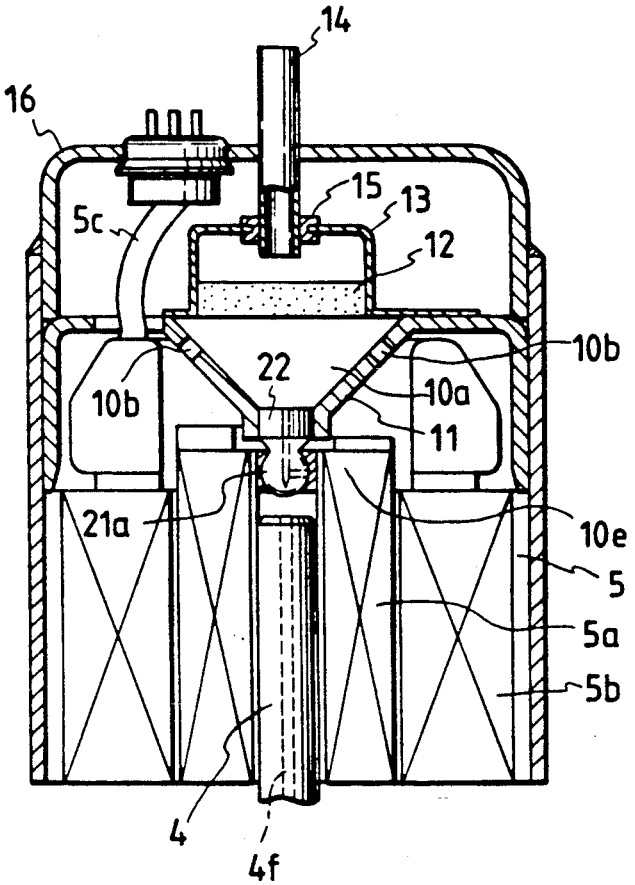
FIG. 11 is a partial sectional view showing the principal part of a further modification of the rotary compressor.

In the illustrated embodiment of FIG. 11, a spherical bearing is provided as in the embodiment shown in FIG. 10 with an upper shaft 22 being press fitted into the frame 11 and includes a spherical sliding surface. A spherical bush 21*a* is press fitted into the rotor 5*a* of the motor 5 to engage the spherical sliding surface of the upper shaft 22 with a slight gap left therebetween. Formed in the upper shaft 22*a* is an oil port 22*a* through which the bottom of the oil collecting portion 10*a* is in fluid communication with the sliding surface of the spherical bearing. This arrangement also provides the same advantageous effects as in the embodiment shown in FIG. 10.

Figure 12:
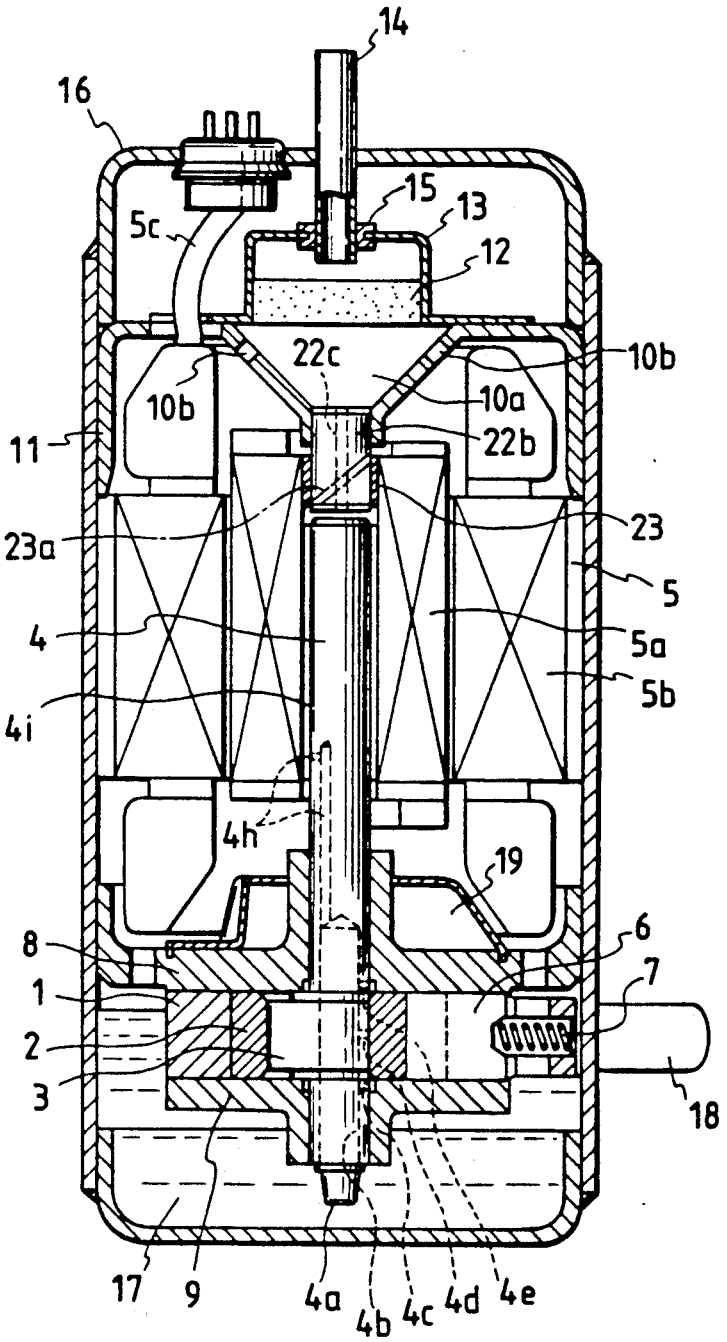
FIGS. 12 through 14 are vertical sectional views showing modified forms of the rotary compressor.

In the rotary compressor of FIG. 12 an oil passage 4*i* is defined in the rotor 5*a* of the motor 5 and is connected to an oil port 4*h* defined in the rotary shaft 4, with the connection being made adjacent to the lower end of the rotor 5*a*. An upper shaft 22*b* is fixedly secured to the frame 11 and is engaged with a bush 23 with a slight gap left therebetween. The bush 23 is, in turn, press fitted into the rotor 5*a*. The lubricating oil 17 flows through a spiral oil channel 23*a* and is supplied to the sliding surface of the upper shaft 22*a*. The upper shaft 22*a* is centrally formed with an oil port 22*c* through which the bottom of the oil collecting portion 10*a*is in fluid communication with the lower portion of the upper shaft 22*b*. This oil port 22*c* serves to direct oil to the bottom of the oil collecting portion 10*a*. With this arrangement, rotation of the rotary shaft 4 improves centrifugal pumping operation of the oil pump 4*a*. As such, a greater amount of oil can be pumped when the motor is rotated at a low speed, thereby ensuring stable lubrication with the aid of oil accumulated in the bottom of the oil collecting portion 10*a*.

Figure 13:
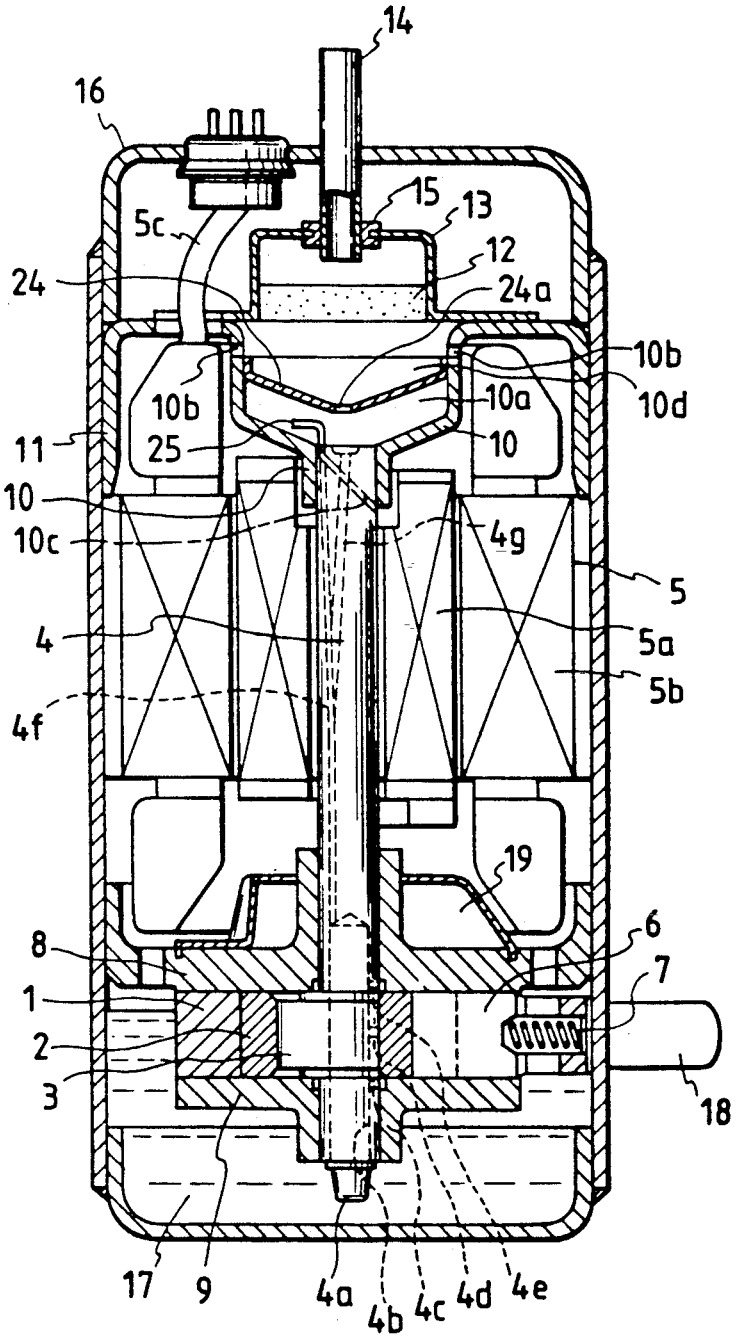

In the embodiment of FIG. 13, an oil collecting plate 24 is fixed to the third bearing section 10 and has a central oil opening 24*a* through which oil as separated and collected is directed to the bottom of the oil collecting portion 10*a*. The oil collecting plate 24 converges toward the oil opening 24*a* so that oil flows downwardly along the upper surface thereof and is located below the gas passage 10*b*. An oil supplier 25 in the form of an inverted L-shaped pipe situated at the upper end of the rotary shaft 4 to communicate with the oil passage 4*f*. An oil passage 4*g* extends in an inclined fashion from the upper end of the rotary shaft 4 to the middle region of the oil passage 4*f*. Illustratively, the spiral oil channel 10*c* is formed in the upper end of the rotary shaft 4. This arrangement is intended to increase a supply of oil while the rotary compressor is running at a low speed. More specifically, oil is separated from the gas through the oil filter 12 and is collected in the oil collecting portion 10*d* by the oil collecting plate 24. Then, the oil flows down to the upper end of the rotary shaft 4 through the oil opening 24*a* and into the oil passage 4*f* through the oil passage 4*g* under the influence of gravity. When the oil passage 4*f* is filled, the oil flows upwardly and is finally injected through the oil pipe 25. As a result, the oil, pipe 25 serves to suction the oil whereby the lubricating oil 17 in the bottom of the casing 16 is raised to the upper end of the oil collecting portion 10*a* and is supplied to the sliding surface of the third bearing 10*e* through the spiral oil channel 10*c*.

Figure 14:
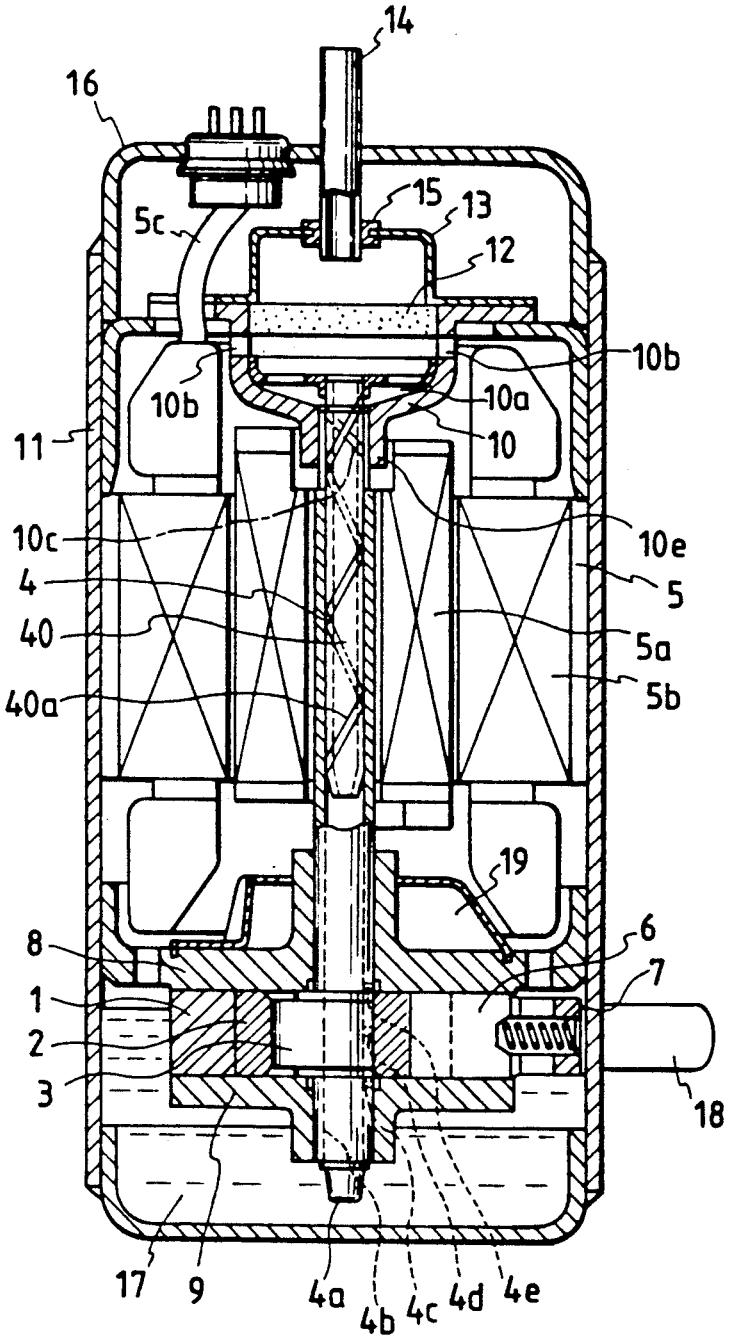

To improve a supply of oil particularly when the rotary compressor is running at a low rotational speed, as shown in FIG. 14, the rotary compressor, similar in construction to the embodiment of FIG. 3, includes an oil pipe rotatable within the oil port 4*b* in the rotary shaft 4 and fixedly secured to the third bearing section 10 by a suitable fastening means. The outer peripheral surface of the oil pipe 40 is formed with a spiral oil channel 40*a* extending to the lower end of the rotor 5*a*. The upper end of the rotary shaft 4 is journalled by the third bearing 10. The oil pump action 4*a* provides a centrifugal pumping upon rotation of the rotary shaft 4, and that the spiral oil channel 40*a* provides viscous pumping due to relative movement between the oil pipe 40 and the rotary shaft 4. A combination of the centrifugal pumping and the viscous pumping ensures a supply of oil to the sliding surface of the third bearing 10*e* while the rotary compressor is running at a low rotational speed. Namely, when the rotary compressor runs at a low rotational speed, oil flows to the lower end of the oil pipe 40 within the oil port 4*b* due to the centrifugal pumping action by the oil pump 4*a*. This oil is further raised due to the viscous pumping by the spiral oil channel 40*a* to reach the oil collecting portion 10*a* in the third bearing section 10, and is supplied to the sliding surface of the third bearing 10*e*. When the rotary compressor runs at a low rotational speed, the temperature is low, and the oil is high in viscosity. In such a case, effective use of the viscous pumping by the oil pipe 40 provides stable lubrication of the sliding surface of the third bearing 10*e*. In the embodiment of FIG. 14, the oil supplier 40 is in the form of a pipe, the outer periphery of which is formed with the spiral oil channel 40*a* however, a coil spring may alternatively be used to obtain the same effects.

As in the embodiment shown in FIGS. 3 and 4, the embodiments shown in FIGS. 5 through 14 are highly reliable as they all provide sufficient lubrication of the upper or third bearing and prevent seizing of the same. Also, the upper portion of the rotary shaft 4 is journalled in a highly reliable bearing assembly, thereby resulting in a substantial increase in the primary natural frequency of the shafts. As such, the vibrations of the shafts are kept rather small even if the rotary compressor runs at a higher rotational speed, thereby ensuring quiet operation of the rotary compressor at all times. Furthermore, the amount of oil discharged out of the rotary compressor can be substantially reduced, thereby ensuring a constant supply of lubricating oil in the closed casing and preventing seizing of the vane. In the embodiments of FIGS. 10 and 11, each of the upper bearings has a spherical surface. When the rotary compressor runs at a high rotational speed, the balance of the rotor may be deteriorated, and resulting centrifugal force may cause deflection of the shaft. The spherical surfaces of the bearings prevent improper contact between the shaft and the bearings which may occur due to the deflection of the shaft. No such improper contact takes place even if the upper bearing is inclined. This allows easy assembly of the rotary compressor. The embodiment of FIG. 14 improves a supply of oil when the rotary compressor runs at a low rotational speed, and thus improves the reliability of the upper bearing.

Figure 15:
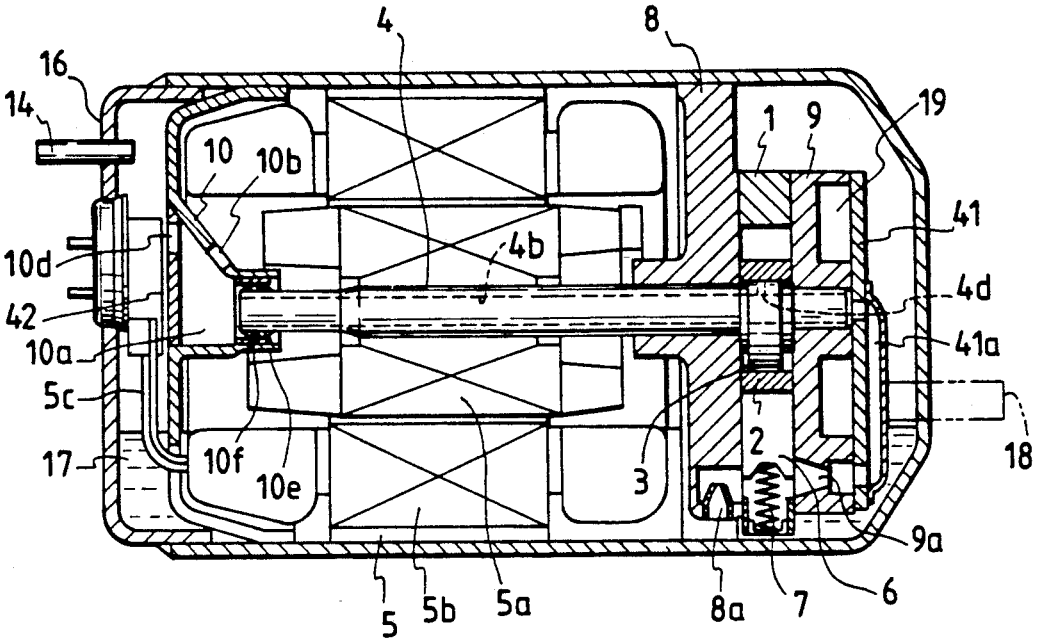
FIG. 15 is a vertical sectional view of a horizontal rotary compressor according to the invention.

In the embodiment of FIG. 15, a horizontal rotary compressor comprises a compression mechanism including the cylinder 1 within which the roller 2 is rotated in an eccentric manner by the crank 3, the rotary shaft 4 integral with the crank 3, the first bearing for rotatably supporting the rotary shaft 4 and defining the compression chamber, and the second bearing 9. The vane 6 is disposed within the cylinder 1 to divide the interior of the cylinder 1 into inlet and compression chambers and is reciprocatingly movable within the cylinder 1 while contacting the roller 2. A spring 7 urges the vane 6 against the roller 2. The cylinder 1 has an inlet port (not shown) through which the inlet pipe 18 is in communication with the inlet chamber. The motor 5 includes the stator 5*b* fixed to the closed casing 16 by a shrink fitting or any other form of fastening process and the rotor 5*a* is fixed to the rotary shaft. The third bearing section 10 is fixed to the inner wall of the casing 16 so as to journal one end of the rotary shaft 4. An impingement plate 42 is fixed to the third bearing section 10. The sliding surface of the third bearing 10*e* is spherical in shape. A spherical bush 10*f* is press fitted into one end of the rotary shaft 4 with a slight gap therebetween and is engaged with the spherical concaved surface of the third bearing 10*e*. The rotational speed of the motor, such as a DC brushless motor, can be varied by the inverter controller 24 in accordance with cooling and heating loads. In this case, the inverter controller 24 receives specific instructions from the microcomputer. As shown, the third bearing 10 surrounds one end of the rotary shaft 4 and is submerged in the oil. An oil separation chamber is defined between the third bearing section and the impingement plate 42. The motor 5 and the compression mechanism are disposed within the casing 16 in such a manner that the rotary shaft 4 extends in a direction perpendicularly to the direction of gravity and is located above the vane 6. The lubricating oil is contained in the bottom of the casing 16, but is not in contact with the rotor 5*a*. A pumping chamber is formed within the casing 16 behind the vane 6. The first bearing 8 has an oil inlet 8*a* with which the pumping chamber is communicated. When oil flows through this oil inlet 8*a*, the resistance to flow is less when the oil flows into the pumping chamber and is greater when the oil flows out of the pumping chamber. The second bearing 9 has an oil outlet 9*a*. When the oil flows through the oil outlet 9*a*, the resistance to flow is less when oil flows out of the the pumping chamber and is greater when the oil flows in the reverse direction. The second bearing 9 is provided with an oil pump. The oil outlet 9*a* is in fluid communication with the oil port 4*b* centrally formed in the rotary shaft 4 through an oil passage 41*a* formed on a cover 41.

In operation, the inverter controller 24 receives instructions from the microcomputer to thereby determined the rotational speed of the motor 5. Rotation of the motor 5 causes the rotary shaft 4 and thus the roller 2 to rotate whereby the capacity of the compression chamber is gradually reduced resulting in an increase in the pressure of the cooling gas introduced through the inlet pipe 18. This high pressure gas enters into the interior of the casing 16 through the discharge valve and the discharge chamber 19. Thereafter, the cooling gas, together with oil mist, flows upwardly through a gap between the rotor 5*a* and the stator 5*b* of the motor 5 and a passageway formed in the outer periphery of the stator 5*b*, enters into the oil collecting portion 10*a* through the gas passage 10*b* in the third bearing section 10, and flows into the circulating system or cycle through the discharge pipe while the oil mist is removed from the cooling gas as the mist impinges against the impingement plate 42. The oil separated from the cooling gas is collected in the bottom of the oil collecting portion under the influence of the gravity to thereby lubricate the upper end of the rotary shaft 4.

Upon rotation of the motor 5, the vane 6 is rendered operative to pump or raise the lubricating oil 17 in the bottom of the casing 16 through the oil inlet 8*a*. The lubricating oil 17 is then discharged through the oil outlet 9*a* and flows into the oil port or passage 4*b* in the rotary shaft 4 via the oil passage 41*a*. Part of the lubricating oil 17 flows through the oil port 4*d* and is supplied through oil channels (not shown) to the sliding surfaces of the bearings. The remaining lubricating oil reaches the upper end of the rotary shaft 4, enters into an oil cover 42 fixed to the third bearing section 10, and is finally supplied to the sliding surface of the spherical bush 10*e*. The impingement plate 42 is secured to the third bearing section 10 and surrounds the end of the rotary shaft 4. The oil mist is separated from the cooling gas as the mist impinges the impingement plate 42. The oil is then collected in the bottom of the oil collecting portion 10*a*, whereby the end of the rotary shaft 4 is submerged therein. This arrangement prevents scattering of the oil to be supplied to the oil port 4*b* in the rotary shaft 4 and thus, provides a stable lubrication of the sliding surface of the third bearing 10*e* preventing seizing of the same. Also, the upper portion of the rotary shaft 4 is journalled by a highly reliable bearing assembly, thereby resulting in a substantial increase in the primary natural frequency of the shafts. As such, the vibrations of the shaft are rather small even if the rotary compressor runs at a higher rotational speed, thereby ensuring quiet operation of the rotary compressor at all times. Furthermore, the amount of oil discharged out of the rotary compressor can be substantially reduced whereby ensuring a constant supply of lubricating oil in the closed casing and preventing seizing of the vane. The rotary compressor is thus sufficiently reliable while it is running at a high rotational speed.

Spherical sliding surface of the third bearing 10*e* prevents improper contact between the third bearing and the rotary shaft 4 even if the rotary shaft is inclined due to deflection or the third bearing 10*e* is accidentally assembled in an inclined fashion. This results in an improvement in the reliability of the third bearing in the horizontal rotary compressor.

Figure 16:
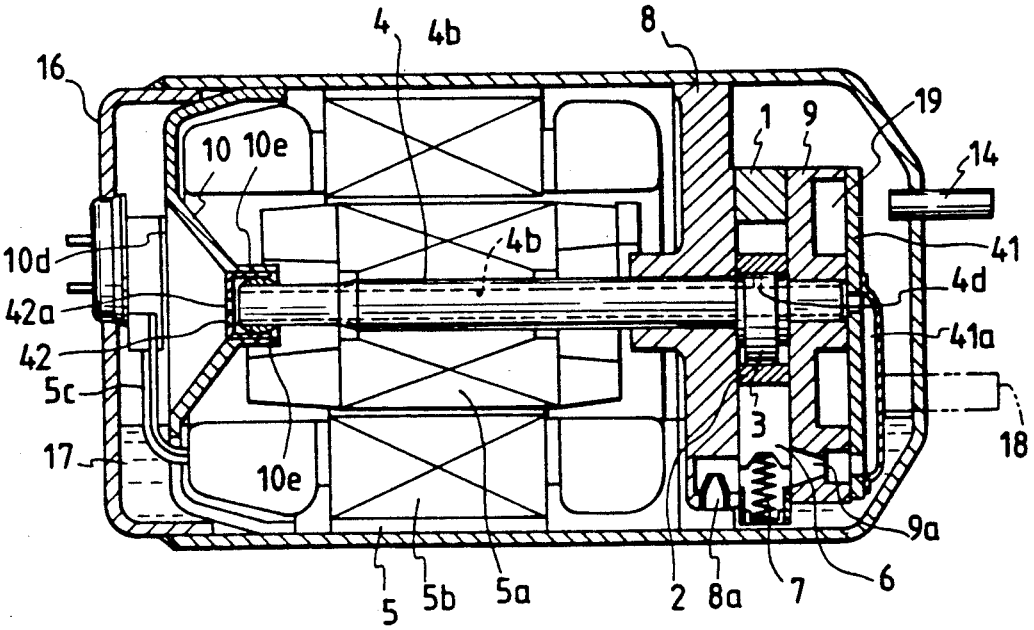
FIG. 16 is a vertical sectional view of a modified form of the horizontal rotary compressor.

The embodiment of FIG. 16 is similar in structure to the embodiment shown in FIG. 15, but is capable of providing a sufficient supply of oil while running at a rotational speed since the oil pump with the reciprocating vane 6 incorporated therein serves to supply oil to the third bearing 10*e*. In lieu of the oil collecting portion 10*a*, an oil cover 42 is fixed to the third bearing section 10 in a surrounding relationship with respect to one end of the rotary shaft 4 and a vent 42*a* formed in the oil cover 42. A combination of the oil cover 42 and the vent 42*a* prevents scattering of the oil supplied to the oil port or passage 4*b* by the oil pump and ensures stable lubrication of the sliding surface of the third bearing 10*e*. This embodiment thus provides the same advantageous effects as in the embodiment shown in FIG. 15.

As stated earlier, in the foregoing embodiments, the oil separating and collecting means are provided around one end of the rotary shaft remote from the compression mechanism. The oil is separated through the oil separating means and is collected in the oil collecting means to thereby lubricate the third bearing by which the end of the rotary shaft is journalled; however, the following measures also be taken.

If the rotary compressor is driven at a low rotational speed by a fixed electric current, then a torque necessary to compress the gas in the compression mechanism can not be equal to a torque generated by the motor. This causes accelaration and deceleration of the rotor 5*a* and causes the rotary compressor to vibrate. To this end, the electric current by which the motor is driven is controlled by a computer so that the torque necessary to compress the gas in the compression mechanism may become equal to the torque generated by the motor. With this arrangement, the rotary compressor is subject to less vibration at any rotational speeds.

Typically, if the rotary compressor rungs at a rotational speed of greater than 12,000 rpm, such rotational speed adversely affects the performance thereof. Therefore, the rotary compressor should not run at a speed of greater than 12,000 rpm. If the primary natural frequency of the rotary shaft is at least five times greater than the frequency of the rotary compressor, then vibrations of the rotary compressor can be sufficiently damped. The rotary compressor is less vibrated particularly when running at a high speed, if the diameter of the rotary shaft is determined such that the primary natural frequency of the rotary shaft is at least 1000 Hz.

If the length of the inlet pipes is determined in such a manner that the primary natural frequency of the inlet pipes is equal to a predetermined maximum frequency of the rotary compressor, then the rotary compressor remains efficiently operative due to inertia supercharging even when the rotational speed of the rotary compressor is over 12,000 rpm. At this time, if the diameter of the rotary shaft is determined in such a manner that the primary natural frequency of the rotary shaft is at least five times greater than a predetermined maximum frequency of the rotary compressor, the rotary compressor is subjected to less vibrations particularly while it is running at a high rotational speed.

The foregoing arrangement permit smaller diameter of the bearing. This serves to reduce the loss of sliding movement and thus, improve the performance of the rotary compressor.

In the cycle, the rotary compressor of the present invention is subject to less vibration while running at a high rotational speed, is quiet, and can be operated at a higher rotational speed than conventional compressors. On the other hand, when the rotary compressor runs at a low speed, the electric current is controlled so that the torque necessary to compress the gas may be equal to the torque generated by the motor. This reduces vibrations of the rotary compressor and thus, allows simplification of a structure for dampening out vibrations of the pipes by which the rotary compressor is connected to the heat exchangers. The length of the pipes can be shortened if vibration acceleration of the pipes is less than 400 gal. The rotary compressor can run at a rotational speed twice as fast as the rotational speed of a conventional compressor. This permits compact arrangement of the rotary compressor. Accordingly, loss of pressure and the amount of heat exchange can be reduced in the pipes. Also, the amount of oil to be discharged to the cycle can be reduced to thereby improve the performance of the heat exchanger. The loss of sliding movement in the rotary compressor can be reduced, thereby decreasing in consumption of energy. By shortening the pipes, the rotary compressor and thus, the overall unit can be brought into a compact arrangement. This allows an air conditioning system to be readily installed. Such air conditioning system can be quiet in operation as the rotary compressor itself is quiet and less vibrated, and short pipes are employed.

In FIG. 1, there is provided a single internal unit; however, a plurality of units can be connected to one another by a cooling gas distributor. The latter provides the same advantageous effects as the single unit does. Additionally, a rotational speed of the rotary compressor can be substantially greater than that of conventional rotary compressor. This allows minute control of the amount of cooling medium to be distributed to each internal unit and thus the cycle to be effectively operated.

The cooling cycle shown in FIG. 2 is operative only to effect cooling. With the rotary compressor of the present invention, the cycle is less vibrated and quiet while running at a high rotational speed, a reduction in the amount of oil discharge thereto is realized and a higher rotational speed than conventional rotary compressors can be achieved. On the other hand, when the rotary compressor runs at a low rotational speed, the electric current is controlled so that the torque necessary to compress the gas may be equal to the torque generated by the motor. This reduces vibrations of the rotary compressor and thus, allows simplification of a structure for dampening out vibrations of the pipes by which the rotary compressor is connected to the heat exchangers. The length of the pipes can be shortened if vibration accelation of the pipes is less than 400 gal. The rotary compressor can run at a rotational speed twice as fast as the rotational speed of a conventional compressor. This permits compact arrangement of the rotary compressor. Accordingly, loss of pressure and the amount of heat exchange can be reduced in the pipes. Also, the amount of oil to be discharged to the cycle can be reduced to thereby improve the performance of the heat exchanger. The loss of sliding movement in the rotary compressor can be reduced, thereby decreasing consumption of energy. By shortening the pipes, the rotary compressor and thus, the overall unit can be brought into a compact arrangement. This allows an air conditioning system to be readily installed. Such air conditioning system can be quiet in operation as the rotary compressor itself is quiet and less vibrated, and short pipes are employed. If this invention is applied to a refrigerator, the effective capacity of its inside can be increased.

Although various preferred embodiments of the present invention have been described herein in detail, it will be appreciated by those skilled in the art, that variations or modifications may be made thereto without departing from the spirit of the invention or the scope of the appended claims.

What is claimed is:

1. A rotary compressor comprising a variable speed motor, a compression mechanism driven by said variable speed motor via a rotary shaft, and a plurality of bearings sandwiching said compression mechanism and rotatably supporting said rotary shaft, the improvement comprising: another bearing rotatably supporting one end of said rotary shaft adjacent to said variable speed motor; oil separation means located outwardly of said bearing for separating oil from gas compressed by said compression mechanism; and oil collection means for collecting said oil as separated by said oil separation means, said another bearing being lubricated by the oil collected in said oil collection means.

2. A rotary compressor according to claim 1, wherein said oil separated by said oil separation is collected under the influence of gravity in said oil collector.

3. A rotary compressor according to claim 1, further comprising an oil collecting plate for separating a gas from oil collected in said oil collector and for preventing scattering of the oil.

4. A rotary compressor according to claim 1, wherein one of said third bearing and said rotary shaft includes a spiral oil channel for directing lubricating oil to said compression mechanism.

5. A rotary compressor according to claim 1, wherein said third bearing includes a sliding surface, and wherein said sliding surface is spherically shaped.

6. A rotary compressor according to claim 5, wherein said third bearing is integrally formed in one piece with said oil separator disposed adjacent said one end of said rotary shaft near said variable speed motor, and wherein said oil collector is provided for collecting oil as separated by said oil separator to thereby lubricate said rotary shaft.

7. A rotary compressor according to claim 1, wherein said oil separation means includes an oil filter.

8. A rotary compressor according to claim 1, wherein said oil separator includes an impingement plate against which a gas impinges.

9. A rotary compressor according to claim 1, wherein said oil separator is constructed such that a gas flows in a cyclical fashion and is separated under centrifugal force therein.

10. A rotary compressor according to claim 1, wherein said oil separator includes a gas injector provided at a frame through which said third bearing is fixed to a casing of the rotary compressor and oriented in a direction tangentially of an inner periphery of said casing to permit a gas to flow in a cyclical fashion.

11. A rotary compressor according to claim 1, wherein said another bearing is located at a rotor of said variable speed motor.

12. A rotary compressor according to claim 1, wherein a bush is provided for mounting said another bearing.

13. A rotary compressor according to claim 1, wherein said rotary shaft includes a spiral oil channel through which a lubricating oil contained in a bottom of said casing flows toward said one end of said rotary shaft.

14. A rotary compressor according to claim 1, further comprising means for controlling an electric current supplied to said variable speed motor such that a torque necessary to compress said gas in said compression mechanism is equal to a torque generated by said variable speed motor, when said rotary compressor runs at a low rotational speed.

15. A rotary compressor comprising:

a casing;

a variable speed motor housed in said casing;

a compression mechanism housed in said casing;

a rotary shaft connected to said variable speed motor and said compression mechanism;

first and second bearings sandwiching said compression mechanism and rotatably supporting said rotary shaft;

a first oil passage formed in said rotary shaft;

a second oil passage branching from said first oil passage to supply oil to said compression mechanism;

a third bearing rotatably supporting one end of said rotary shaft adjacent to said variable speed motor;

an oil separator for separating oil from gas compressed by said compression mechanism;

an oil collector for collecting oil separated by said oil separator;

means for lubricating said third bearing with oil collected by said collector; and a passage for returning the oil to said casing after said third bearing has been lubricated thereby, wherein said lubricating means includes at least one of means for flowing a lubricating oil contained in said casing into a compression chamber through said second oil passage, separating an oil discharge out of said compression mechanism through said oil separator, and collecting said oil, and means for supplying a lubricating oil contained in said casing through said first oil passage.

16. A rotary compressor comprising:

a compression mechanism housed in a casing and including a rotary shaft having an eccentric crank and driven by a variable speed motor;

a roller engaged with said crank and rotatable within a cylinder;

first and second bearings located at opposite ends of said roller and rotatably supporting said rotary shaft, said first and second bearings being fixed to said cylinder and serving as end plates;

a vane reciprocatingly movable within said cylinder while contacting said roller;

a third bearing rotatably supporting one end of said rotary shaft adjacent to said variable speed motor;

an oil separator located outwardly of said third bearing for separating oil from gas compressed by said compression mechanism; and an oil collector for collecting oil separated by said oil separator, said third bearing being lubricated by oil contained in said oil collector.

17. A rotary compressor according to claim 16, wherein a predetermined maximum frequency of said rotary compressor is equal to a primary natural frequency of an inlet pipe connected to an inlet port of said rotary compressor.

18. A rotary compressor comprising:

a compression mechanism housed in a casing and including a rotary shaft having an eccentric crank and driven by a variable speed motor;

a roller engaged with said crank and rotatable within a cylinder;

first and second bearings located at opposite ends of said roller and rotatably supporting said rotary shaft, said first and second bearings being fixed to said cylinder and serving as end plates;

a van reciprocatingly movable within said cylinder while contacting said roller;

a passage formed in such a manner that a compressed gas discharged out of said compression mechanism flows through an oil separator situated adjacent to one end of said rotary shaft near said variable speed motor with the oil separator separating oil from the compressed gas;

a third bearing integrally formed with said oil separator and rotatably supporting one end of said rotary shaft; and an oil collector collecting the oil separated by said oil separator, said one end of said rotary shaft being submerged in the oil to thereby lubricate said third bearing.

19. A rotary compressor comprising:

a compression mechanism housed in a casing and including a rotary shaft having an eccentric crank and driven by a variable speed motor;

a roller engaged with said crank and rotatable within a cylinder;

first and second bearings located at opposite ends of said roller and rotatably supporting said rotary shaft, said first and second bearings being fixed to said cylinder and serving as end plates;

a vane reciprocatingly movable within said cylinder while contacting said roller;

an oil separator for separating oil from gas compressed by said compressor mechanism;

an oil collector for collecting oil separated by said separator; and a third bearing, said oil separator, said oil collector and said third bearing being all located adjacent to one end of said rotary shaft near said variable speed motor, said third bearing rotatably supporting said one end of said rotary shaft and being lubricated by said oil separated by said oil separator and collected in said oil collector and a lubricating oil contained in a bottom of said casing and supplied through an oil port in said rotary shaft.

20. A rotary compressor comprising:

a compression mechanism housed in a casing and including a rotary shaft having an eccentric crank and driven by a variable speed motor;

a roller engaged with said crank and rotatable within a cylinder;

first and second bearings located at opposite ends of said roller and rotatably supporting said rotary shaft, said first and second bearings being fixed to said cylinder and serving as end plates;

a vane reciprocatingly movable within said cylinder while contacting said roller;

a third bearing having a sliding surface rotatably supporting said shaft and said third bearing, an oil separator separating oil from gas compressed by said compression mechanism and an oil collector collecting oil separated by said separator provided at one end of said rotary shaft adjacent to said variable speed motor with the third bearing being lubricated by oil separated by said oil separator and collected by said oil collector, and wherein a diameter of said rotary shaft is determined in such a manner that a primary natural frequency of said rotary shaft is at least 1000 Hz.

21. A rotary compressor comprising:

a compression mechanism housed in a casing and including a rotary shaft having an eccentric crank and driven by a variable speed motor;

a roller engaged with said crank and rotatable within a cylinder;

first and second bearings located at opposite ends of said roller and rotatably supporting said rotary shaft, said first and second bearings being fixed to said cylinder and serving as end plates;

a vane reciprocatingly movable within said cylinder while contacting said roller;

a third bearing having a sliding surface rotatably supporting said shaft and said third bearing, an oil separator separating oil from gas compressed by said compression mechanism and an oil collector collecting oil separated by said separator provided at one end of said rotary shaft adjacent to said variable speed motor with the third bearing being lubricated by oil separated by said oil separator and collected by said oil collector, and wherein a diameter of said rotary shaft is determined in such a manner that a primary natural frequency of said rotary shaft is at least five times greater than a predetermined maximum frequency of said rotary compressor.

22. A rotary compressor comprising:

a variable speed motor;

compression means driven by said variable speed motor for compressing a medium containing oil;

a rotary shaft for connecting said variable speed motor to said compression means;

a first bearing for rotatably supporting said shaft and disposed on a first side of said compression means;

a second bearing for rotatably supporting said shaft and disposed on a second side of said compression means opposite said first side thereof such that said compression means is interposed between said first and second bearing;

a third bearing for rotatably supporting one end of said rotary shaft at a position adjacent said variable speed motor;

means provided at said third bearing for separating oil from said medium;

means provided at said third bearing for collecting separated oil and for lubricating said third bearing; and wherein said means for separating includes a frustoconically-shaped baffle plate mounted on said third bearing mounted on said third bearing at a position above said one end of said rotary shaft; and an impingement plate is arranged substantially centrally of said baffle plate for forming an impingement surface to enable a separation of the oil.

23. A rotary compressor according to claim 22, wherein said means for separating oil includes an impingement plate mounted on said third bearing in such a manner that the medium impinges thereon for causing a separation of oil from the medium.

24. A rotary compressor according to claim 23, wherein said means for collecting and for lubricating said third bearing includes a cup-shaped oil collecting chamber integrally formed in one piece with said third bearing and disposed between said impingement plate and bearing portion of said third bearing supporting said rotary shaft.

25. A rotary compressor according to claim 24, wherein said means for collecting and for lubricating further includes a spiral channel at said one end of said rotary shaft for communicating said oil collecting chamber with bearing surfaces of said bearing portion of said third bearing.

26. A rotary compressor according to claim 22, wherein said means for collecting and for lubricating includes a conically shaped collecting chamber arranged between said one end of said rotary shaft and said baffle plate and mounting a bearing section of said third bearing.

27. A rotary compressor according to claim 26, wherein said means for collecting and for lubricating further includes a spiral channel at said one end of said rotary shaft for communicating said conically shaped collecting chamber with bearing surfaces of said bearing section of said third bearing.

28. A rotary compressor according to claim 22, wherein said means for collecting and for lubricating includes a conically shaped collecting chamber arranged between said one end of said rotary shaft and said baffle plate and mounting a bearing section of said third bearing.

29. A rotary compressor according to claim 28, wherein said means for collecting and for lubricating further includes a spiral channel at said one end of said rotary shaft for communicating said conically shaped collecting chamber with bearing surfaces of said bearing section of said third bearing.

30. A rotary compressor according to claim 22, wherein a cover is provided for mounting said baffle plate on said third bearing at a position adjacent to and in confrontation with a discharge pipe of the rotary compressor, and wherein an inlet for the medium is provided in the cover for enabling a medium to enter the cover in a tangential direction resulting in a cyclical motion of the medium so as to cause separation of the oil.

31. A rotary compressor according to claim 30, wherein said means for collecting and for lubricating includes a conically shaped collecting chamber arranged between said one end of said rotary shaft and said baffle plate and mounting a bearing section of said third bearing.

32. A rotary compressor according to claim 31, wherein said means for collecting and for lubricating further includes a spiral channel at said one end of said rotary shaft for communicating said conically shaped collecting chamber with bearing surfaces of said bearing section of said third bearing.

33. A rotary compressor according to claim 22, wherein said means for separating oil includes a passage provided in said third bearing for imparting a centrifugal flow to the medium so as to cause the separation of oil therefrom.

34. A rotary compressor according to claim 22, wherein said means for separating oil includes an injection pipe means arranged in the third bearing for injecting the medium in such a manner that the medium impinges upon a portion of a casing of the rotary compressor so as to cause a separation of the oil.

35. A rotary compressor according to claim 24, wherein the rotary shaft includes a spherical bush mounted on said one end of the rotary shaft and cooperable with the bearing portion of said third bearing.

36. A rotary compressor according to claim 24, wherein said third bearing includes a bearing portion comprising a shaft press fitted into a frame of said third bearing and a spherical bearing press fitted into a rotor portion of said variable speed motor.

37. A rotary compressor according to claim 24, wherein said third bearing includes a shaft section having one end press fitted into a frame of the third bearing and an opposite end press fitted into a rotor of the variable speed motor, and wherein said means for collecting and for lubricating includes a spiral channel in said shaft section for supplying oil to sliding surfaces of said shaft section.

38. A rotary compressor comprising:

a variable speed motor;

compression means driven by said variable speed motor for compressing a medium containing oil;

a rotary shaft for connecting said variable speed motor to said compression means;

a first bearing for rotatably supporting said shaft means and disposed on a first side of said compression means;

a second bearing for rotatably supporting said shaft and disposed on a second side of said compression means opposite said first side thereof such that said compression means is interposed between said first and second bearings;

a third bearing for rotatably supporting one end of said rotary shaft at a position adjacent said variable speed motor;

means provided at said third bearing for separating oil from said medium;

means provided at said third bearing for collecting separated oil and for lubricating said third bearing;

said means for collecting and for lubricating said third bearing includes a cup-shaped oil collecting chamber integrally formed in one piece with said third bearing and disposed between said impingement plate and bearing portion of said third bearing supporting said rotary shaft; and said means for collecting and for lubricating includes an oil collecting plate arranged in said collecting chamber and interposed between said impingement plate and said one end of said rotary shaft, an oil supply pipe for communicating said collecting chamber with a lubricating reservoir of the rotary compressor, and a spiral channel at said one end of said rotary shaft for communicating said oil collecting chamber with bearing surfaces of said bearing portion of said third bearing.

39. A rotary compressor comprising:

a variable speed motor;

compression means driven by said variable speed motor for compressing a medium containing oil;

a rotary shaft for connecting said variable speed motor to said compression means;

a first bearing for rotatably supporting said shaft and disposed on a first side of said compression means;

a second bearing for rotatably supporting said shaft and disposed on a second side of said compression means opposite said first side thereof such that said compression means is interposed between said first and second bearings;

a third bearing for rotatably supporting one end of said rotary shaft at a position adjacent said variable speed motor;

means provided at said third bearing for separating oil from said medium;

means provided at said third bearing for collecting separated oil and for lubricating said third bearing;

said means for collecting and for lubricating said third bearing includes a cup-shaped oil collecting chamber integrally formed in one piece with said third bearing and disposed between said impingement plate and bearing portion of said third bearing supporting said rotary shaft; and said rotary shaft is a hollow said, said means for collecting and for lubricating includes an oil pipe rotatably mounted in said rotary shaft and fixedly secured to said third bearing, and a spiral channel formed in said oil pipe for forming a viscous pump to supply lubricating oil from an oil reservoir of the rotary compressor to bearing surfaces of the bearing portion of said third bearing.

* * * * *